US006276122B1

(12) United States Patent
Büchner et al.

(10) Patent No.: US 6,276,122 B1
(45) Date of Patent: Aug. 21, 2001

(54) APPARATUS FOR THE GUIDANCE OF THREAD IN A SPINNING STATION

(75) Inventors: Thorsten Büchner, Abensberg; Bernd Bahlmann, Schrobenhausen; Edmund Schuller, Ingolstadt, all of (DE)

(73) Assignee: Rieter Ingolstadt Spinnereimaschinenbau AG, Ingolstadt (DE)

( * ) Notice: Subject to any disclaimer, the term of this patent is extended or adjusted under 35 U.S.C. 154(b) by 0 days.

(21) Appl. No.: 09/428,063

(22) Filed: Oct. 27, 1999

(30) Foreign Application Priority Data

Nov. 3, 1998 (DE) ..... 198 50 538

(51) Int. Cl.[7] ..... D01H 13/26

(52) U.S. Cl. ..... 57/265; 57/263; 57/264; 57/278; 73/160

(58) Field of Search ..... 57/75, 263, 264, 57/278; 73/160; 377/16; 242/476.4; 700/143

(56) References Cited

U.S. PATENT DOCUMENTS 3,335,046 8/1967 Current et al. .
3,380,676 4/1968 Jenny .
4,716,718 * 1/1988 Gobbels et al. ..... 57/263
5,330,115 * 7/1994 Mayer et al. ..... 242/18
5,592,849 * 1/1997 Nakade et al. ..... 73/160
5,799,476 * 9/1998 Bahlmann ..... 57/264

FOREIGN PATENT DOCUMENTS 1184449 12/1964 (DE) .

OTHER PUBLICATIONS

German Patent Office Search Report, May 6, 1999.

* cited by examiner

*Primary Examiner*—John J. Calvert
*Assistant Examiner*—Shaun R Hurley
(74) *Attorney, Agent, or Firm*—Dority & Manning

(57) ABSTRACT

The invention concerns an apparatus for the guidance of a spun thread in a spinning station, wherein, after the thread has been produced, it runs in its travel direction through a withdrawal device, a measuring instrument, and a traversing apparatus. The invention makes possible a smooth and stable thread guidance between the withdrawal device and the traversing apparatus, so that both the run of the thread and the quality of wound filament of the thread can be monitored. Between the measuring instrument and the traverse apparatus, at least one deflection roll is provided.

6 Claims, 1 Drawing Sheet

APPARATUS FOR THE GUIDANCE OF THREAD IN A SPINNING STATION

BACKGROUND

The present invention concerns an apparatus for the guidance of a spun thread in a spinning station.

It is known that thread monitoring devices are mounted on spinning machines for the monitoring of the run of thread. Moreover, in spinning machines with filament cleaning, the wound filament quality is monitored by means of a measuring instrument. The position of the thread monitor follows a withdrawal apparatus and is free of access for automation equipment. Known thread monitors operate in accord with the optical principle of a bifurcated light relay. Moreover, these said thread monitors act to assure a reliable thread guidance but do not supervise the wound filament quality.

For the monitoring of wound filament quality, it is necessary that a thread run is provided which is smooth and closely parallel to the measuring sensor. Further, in the installation of the measuring head, care must be taken that sufficient space is available about the measuring head in order to provide the head with a recognition means for detecting unwanted fibers.

Because of the traverse motion of the thread following the withdrawal apparatus, it is not possible to guarantee a smooth and stable thread run after the withdrawal apparatus. On this account, the measuring head for the monitoring of the wound filament quality cannot be located after the withdrawal apparatus.

SUMMARY OF THE INVENTION

Thus, a purpose of the present invention is to make possible a smooth and stable guidance of the thread between a withdrawal apparatus and a transversing apparatus, and to so design this that both the run of the thread and the quality of the wound filament are monitored. Additional objects and advantages of the invention will be set forth in part in the following description, or may be obvious from the description, or may be learned through practice of the invention.

This purpose will be achieved by the features in the invention wherein an apparatus for the guidance of a spun thread (3) in a spinning station is provided, wherein, after the thread (3) has been produced, it runs in its travel direction through a withdrawal device (4), a measuring instrument (7) and a traversing apparatus (9), therein characterized, in that between the measuring instrument (7) and the traverse apparatus, at least one deflection roll (8) is arranged.

After its production, the thread, in an already established direction, runs through a withdrawal apparatus and thereafter through a measuring instrument and into a traversing apparatus. The essence of the invention is that between the measuring instrument and the traversing apparatus, at least one deflector roll has been inserted. By means of the stationary deflector device, a smooth and stable run of the thread is maintained between the withdrawal apparatus and the deflector roll. In this way, the measuring instrument can monitor the thread run as well as the wound filament quality. In an advantageous manner, the deflector roll is so placed that the necessary conditions for the installation of a thread supervision device, i.e. a measuring head, are fulfilled. To serve as a measuring instrument, a thread monitor or a measuring head can be considered.

In order to keep threads of differing diameters running with axial precision, the deflector roll possesses a special, V-shaped groove. Since there is relative movement between the deflector roll and the running thread, the groove avoids a detrimental action on the wound filament composition.

Additional advantage is provided when the opening angle of the groove is greater than the angle between the most extreme positions of the traverse. The traverse operates through a relative movement at right angles to the running thread in order to wind the thread onto a spool. The greater opening angle of the V-groove takes care that the thread is not drawn over the edge of the groove by the traversing movement. Advantageously, the angle is not made too large in order to prevent that the traverse movement from extending itself back onto the run of the thread between the withdrawal apparatus and the deflector roll. Since no eyelet is required for the guidance of the deflector roll, an automatic server can lay the thread in the groove without any problem.

Even so, it is of advantage if the measuring instrument between the withdrawal apparatus and the deflector roll is designed for the measurement, that is the monitoring, of both the thread run and the quality of the wound filament.

Thus, with such a measuring instrument, both tasks can be carried out simultaneously or in alternation, so that exchanging the measuring instrument upon change of the monitoring purpose is no more required. Beyond this, costs are reduced, since only one measuring instrument is required. Likewise, production costs are substantially reduced, because, for instance, supply lines for a measurement instrument are no longer required beneath the withdrawal apparatus.

In a development of the invention, the measuring instrument is designed for the monitoring of the wound filament quality and in addition to this issues at least one, preferably digital, signal for the monitoring of the run of the thread. Advantageous for such a case, is that where spinning machines with wound filament monitoring are concerned, the thread monitor is not necessary since both monitoring operations are possible with only one instrument. Where instrumentation is concerned, such a use reduces the production costs per spinning station. The additional digital signal of the measurement instrument displays the run of the thread.

It is particularly favorable if, between the measurement instrument and the deflector roll, a distance of 2 to 50 mm is observed. This enables a uniform quality wind-up of the spun thread onto the spool arrangement.

An embodiment of the invention will be shown in greater detail with the help of the drawings.

DETAILED DESCRIPTION

Reference will now be made in detail to a presently preferred embodiment of the invention as illustrated in the figures. It should be appreciated that the example shown is not meant as a limitation of the invention, but is provided by way of explanation of the invention. Modifications and variations can be made without departing from the scope and spirit of the invention.

Figure 1:
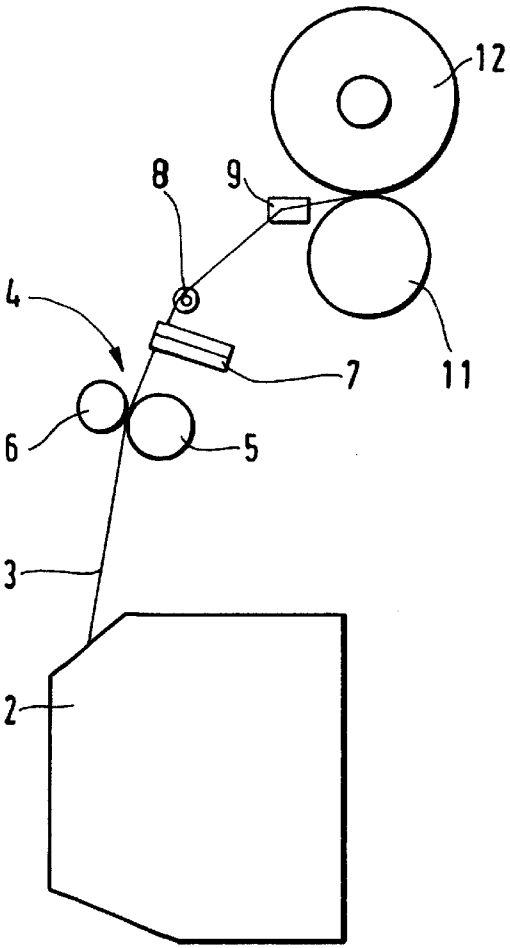
FIG. 1 a spinning station in a side view.

FIG. 1 shows a spinning station with a spinning apparatus 2, from which is pulled a spun thread 3 by means of a withdrawal apparatus 4. The withdrawal apparatus is formed by a withdrawal roll 5 and a pressure roll 6, to which the thread 3 is led.

Above the withdrawal apparatus 4 is placed a deflector roll 8 and between the withdrawal apparatus 4 and the said deflector roll 8 a measurement instrument 7 is to be found. By means of this arrangement, thread 3 proceeds in a smooth and stable manner between the sensing surfaces of the measurement instrument 7.

The deflector roll 8 is stationary in its place and undergoes no relative motion across the thread line, i.e. the direction of motion of the thread.

In that same direction of motion, the thread 3 runs through a traverse shoe 9, which moves the thread 3 in such a way, that the thread is wound upon a spool 12 by means of a spool roll 11. The traverse shoe 9 is movable and describes a motion at right angles to that of the thread 3.

Figure 2:
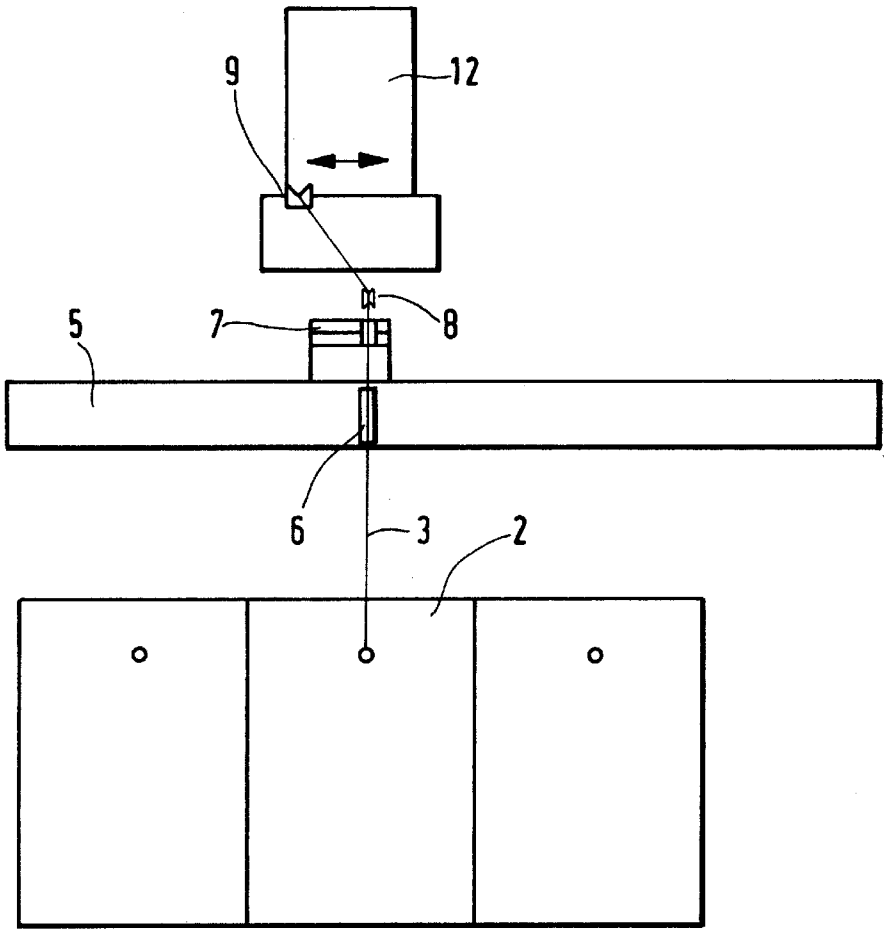
FIG. 2 a front view of the spinning station.

In FIG. 2 is presented a front view of FIG. 1. The traverse shoe 9, as has been said, moves at right angles to the running direction of the thread 3. In order to obtain a satisfactory and assured guidance of the thread on the deflector roll 8, the deflector roll is designed with a V-shaped groove. The opening angle of the groove is slightly larger than the angle between the back and forth extremes of the traverse shoe 9. This ensures that the thread is not pulled out of the groove and moreover, no deleterious reaction occurs on the measuring instrument by pulling forces on the thread. The thread 3, between the withdrawal roll 5 and the deflector roll 8 experiences no lateral force and is guided in a linear manner.

The invention makes possible a stable and smooth guidance for the thread between a traverse apparatus and a withdrawal apparatus, so that a measuring instrument disposed therebetween can be employed both for the monitoring of the run of the thread and overseeing the quality of the wound filament. By this means, the expense for the production of a spinning station and also costs for an additional measuring instrument have been reduced.

It should be appreciated by those skilled in the art that various modifications and variations can be made in the present invention. It is intended that such modifications and variations are included in the invention as come within the scope of the appended claims and their equivalents.

What is claimed is:

1. An apparatus for guiding a thread at a spinning station under normal operational spinning production, comprising:

a withdrawal device through which the thread runs after it has been produced;

a measuring instrument operably disposed in the running path of the withdrawn thread to detect a characteristic of the thread;

a traversing device disposed after said withdrawal device in the running path of the thread, said traversing device configured to move the thread in a traversing back-and-forth motion transverse to the running direction of the thread prior to the thread being taken up; and a deflection roll disposed in the running path of the thread between said measuring instrument and said traversing device, said deflection roll having a groove to allow the thread after said deflection roll to move back and forth in response to the back and forth motion of said traversing device, said groove allowing a smooth and stable run of the thread between said withdrawal device and said deflection roll for said measuring instrument.

2. The apparatus as in claim 1, wherein said deflection roll comprises a generally V-shaped circumferential groove through which the thread runs.

3. The apparatus as in claim 2, wherein said groove comprises sides disposed at an angle greater than an angle from said deflection roll to the outer reversing positions of said traversing device.

4. The apparatus as in claim 1, wherein said measuring instrument detects the thread in its running path and monitors quality of the thread being withdrawn therepast.

5. The apparatus as in claim 4, wherein said measuring instrument generates a digital signal.

6. The apparatus as in claim 1, wherein a distance of about 2 mm to about 50 mm is defined between said measuring instrument and said deflection roll.

* * * * *